US009057133B2

(12) United States Patent
Inoue et al.

(10) Patent No.: US 9,057,133 B2
(45) Date of Patent: Jun. 16, 2015

(54) PROCESSING SOLUTION FOR FORMING HEXAVALENT CHROMIUM FREE, BLACK CONVERSION FILM ON ZINC OR ZINC ALLOY PLATING LAYERS, AND METHOD FOR FORMING HEXAVALENT CHROMIUM FREE, BLACK CONVERSION FILM ON ZINC OR ZINC ALLOY PLATING LAYERS

(75) Inventors: Manabu Inoue, Tokyo (JP); Ryo Nakajima, Tokyo (JP); Kazuhiro Watanabe, Tokyo (JP); Toyoji Watanabe, legal representative, Fuji (JP); Fumie Watanabe, legal representative, Fuji (JP); Yutaka Watanabe, legal representative, Fuji (JP); Takeshi Watanabe, legal representative, Fuji (JP); Kimitaka Watanabe, Tokyo (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 307 days.

(21) Appl. No.: 12/401,202

(22) Filed: Mar. 10, 2009

(65) Prior Publication Data

US 2009/0178734 A1 Jul. 16, 2009

Related U.S. Application Data

(63) Continuation of application No. 10/939,555, filed on Sep. 14, 2004, now abandoned, which is a continuation of application No. PCT/JP03/02994, filed on Mar. 13, 2003.

(30) Foreign Application Priority Data

Mar. 14, 2002 (JP) ..... 2002-70175

(51) Int. Cl.
*C23C 22/33* (2006.01)
*C23C 22/17* (2006.01)
*C23C 22/53* (2006.01)
*C23C 22/47* (2006.01)

(52) U.S. Cl.
CPC ..... *C23C 22/17* (2013.01); *C23C 22/47* (2013.01); *C23C 22/53* (2013.01); *C23C 2222/10* (2013.01)

(58) Field of Classification Search
USPC ..... 148/258, 267; 106/14.05
See application file for complete search history.

(56) References Cited

U.S. PATENT DOCUMENTS

| | | | |
|---|---|---|---|
| 4,196,063 | A | 4/1980 | Barnes et al. |
| 4,359,348 | A | 11/1982 | Crotty |
| 4,578,122 | A | 3/1986 | Crotty |
| 4,931,317 | A | 6/1990 | Shima et al. |
| 5,415,702 | A | 5/1995 | Bishop et al. |
| 6,287,704 | B1 | 9/2001 | Preikschat et al. |
| 6,719,852 | B2 | 4/2004 | Oshima et al. |
| 6,858,098 | B2 | 2/2005 | Oshima et al. |
| 7,029,541 | B2 | 4/2006 | Diaddario et al. |
| 2001/0050522 | A1 | 12/2001 | Nasu et al. |
| 2005/0103403 | A1 | 5/2005 | Oshima et al. |

FOREIGN PATENT DOCUMENTS

| | | |
|---|---|---|
| DE | 196 15 664 A1 | 10/1997 |
| JP | 2001-107273 | 4/2001 |
| JP | 2002-69660 | 3/2002 |
| WO | WO 02/07902 A2 | 1/2002 |
| WO | WO 02/07902 A3 | 1/2002 |

*Primary Examiner* — Rebecca Lee
(74) *Attorney, Agent, or Firm* — Oblon, McClelland, Maier & Neustadt, L.L.P.

(57) ABSTRACT

It is an object of the present invention to provide a processing solution used for forming a hexavalent chromium free, black conversion film, which is applied onto the surface of zinc or zinc alloy plating layers, and which has corrosion resistance identical to or higher than that achieved by the conventional hexavalent chromium-containing conversion film.

9 Claims, No Drawings

PROCESSING SOLUTION FOR FORMING HEXAVALENT CHROMIUM FREE, BLACK CONVERSION FILM ON ZINC OR ZINC ALLOY PLATING LAYERS, AND METHOD FOR FORMING HEXAVALENT CHROMIUM FREE, BLACK CONVERSION FILM ON ZINC OR ZINC ALLOY PLATING LAYERS

This application is a continuation application of U.S. application Ser. No. 10/939,555 filed Sep. 14, 2004, abandoned, which is a continuation application of PCT/JP03/02994 filed Mar. 13, 2003.

FIELD OF TECHNOLOGY

The present invention relates to a processing solution for forming a hexavalent chromium free, black conversion film on zinc or zinc alloy plating layers, and a method for forming the hexavalent chromium free, black conversion film on zinc or zinc alloy plating layers.

TECHNICAL BACKGROUND

As methods for rust preventing the surface of a metal, there has been known a zinc or zinc alloy-plating method. However, it is not possible to ensure sufficient corrosion resistance of the metal by such plating alone. For this reason, there has widely been adopted, in this industrial field, the treatment with chromic acid containing hexavalent chromium or the so-called chromate treatment after the plating. Nevertheless, it has recently been pointed out that the hexavalent chromium may adversely affect the human body and the environment and there has correspondingly been such a strong and active trend that the use of hexavalent chromium should be controlled.

As one of the substituent techniques therefor, the formation of a corrosion resistant conversion film, in which trivalent chromium is used, has been known. For instance, Japanese Examined Patent Publication (hereunder referred to as "J.P. KOKOKU") No. Sho 63-015991 discloses a method, which comprises the step of treating the surface of a metal with a bath containing a mixture of trivalent chromium and a fluoride, an organic acid, an inorganic acid and/or a metal salt such as cobalt sulfate. However, a fluoride is used in this plating bath and therefore, a problem of environmental pollution would arise. In addition, J.P. KOKOKU No. Hei 03-010714 discloses a method, which makes use of a plating bath comprising a mixture of trivalent chromium and an oxidizing agent, an organic acid, an inorganic acid and/or a metal salt such as a cerium salt. However, this method makes use of an oxidizing agent and cerium and therefore, the trivalent chromium may possibly be oxidized into hexavalent chromium, during the processing and/or the storage of the bath.

Japanese Un-Examined Patent Publication (hereunder referred to as "J.P. KOKAI") No. Hei 10-183364 discloses a method which comprises the step of treating the surface of a metal with a bath containing a phosphoric acid, a salt of metal such as Mo, $Cr^{3+}$ and Ti, and an oxidizing agent to provide the surface with a hexavalent chromium free, corrosion resistant conversion film. This method uses a large quantity of the oxidizing agent and therefore, the trivalent chromium may possibly be oxidized into a hexavalent chromium, during the processing and/or the storage of the bath.

J.P. KOKAI No. 2000-54157 discloses a method which comprises the step of chemical conversion treating the surface of a metal with a bath containing phosphorus, a metal such as Mo, and trivalent chromium, but no fluoride. However, as a result of our experiments to confirm the effects produced by the method, acceptable corrosion resistance could not be obtained.

Furthermore, J.P. KOKAI No. 2000-509434 discloses a method, which comprises the step of treating the surface of a metal using a plating bath comprising 5 to 100 g/L of trivalent chromium and nitrate residues, an organic acid and/or a metal salt such as a cobalt salt. This method uses, for instance, trivalent chromium in a high concentration and the plating operation is carried out at a high temperature. Therefore, this method is advantageous in that it can form a thick film and ensure good corrosion resistance. However, the method suffers from a problem in that it is difficult to stably form a dense film and that the method cannot ensure the stable corrosion resistance of the resulting film. Moreover, the processing bath contains trivalent chromium in a high concentration and also contains a large amount of an organic acid. This makes the post-treatment of the waste water difficult and results in the formation of a vast quantity of sludge after the processing. Although one can recognize that it is advantageous to use a processing solution free of any hexavalent chromium for ensuring the environmental protection, the method suffers from a serious problem in that it may give a new burden to the environment such that the method generates a vast quantity of waste.

In addition, there could be obtained only films having colorless or an interference color appearances. In this connection, with regard to a black conversion film containing a trivalent chromium on zinc-nickel alloy plating layers (containing 8% or more of nickel in the layers) and zinc-iron alloy plating layers, U.S. Pat. No. 5,415,702 discloses a method which comprises the step of treating the surface of a metal with an acidic bath containing a phosphate compound and trivalent chromium. Also, with regard to a chemical conversion interference color film containing a trivalent chromium on zinc-nickel alloy plating layers (containing 8% or more of nickel in the layers), U.S. Pat. No. 5,407,749 discloses a method, which comprises the step of treating the surface of a metal with an acidic bath similar to that disclosed in U.S. Pat. No. 5,415,702 containing a phosphorus compound, trivalent chromium and oxy-halogen acid ions.

However, in many cases, a Ni eutectoid rate in zinc-nickel alloy plating layers actually produced is less than 8%, and thus it is difficult to obtain a black feature from a practical standpoint. Furthermore, the black conversion film on zinc-iron alloy plating layers does not have enough corrosion resistivity.

Moreover, there have been proposed a method for processing the surface of a metal with a bath containing trivalent chromium in a low concentration and an organic acid and a metal salt such as a nickel salt (U.S. Pat. No. 4,578,122) and a processing method, which makes use of a bath containing trivalent chromium in a low concentration and an organic acid (U.S. Pat. No. 5,368,655). However, these methods never ensure sufficient corrosion resistance of the resulting film as compared with the conventional hexavalent chromate treatment.

It is thus an object of the present invention to provide a processing solution used for forming a hexavalent chromium free, black conversion film, which is applied onto the surface of zinc or zinc alloy plating layers, and which has corrosion resistance identical to or higher than that achieved by the conventional hexavalent chromium-containing conversion film.

Another object of the present invention is to provide a method for forming such a hexavalent chromium free, black conversion film.

SUMMARY OF THE INVENTION

The present invention has been completed on the basis of such finding that the foregoing problems associated with the conventional techniques can effectively be solved by depositing a zinc or zinc alloy plating layer(s) on a substrate and then subjecting the plating layer to a trivalent chromate treatment using a processing solution having a specific composition, i.e. containing a low concentration of nitrate ions, cobalt ions and nickel ions.

According to an aspect of the present invention, there is provided a processing solution for forming a hexavalent chromium free, black conversion film on zinc or zinc alloy plating layers and the processing solution comprises:

nitrate ions and trivalent chromium in a mole ratio ($NO^{3-}/Cr^{3+}$) of less than 0.5/1, wherein the trivalent chromium is present in the form of a water-soluble complex with a chelating agent; and cobalt ions and/or nickel ions, wherein cobalt ions and/or nickel ions are stably present in the processing solution without causing any precipitation by forming a hardly soluble metal salt with the chelating agent; wherein the solution reacts with zinc when it is brought into contact with the zinc or zinc alloy plating to form a hexavalent chromium free, black conversion film containing zinc, chromium, cobalt and/or nickel, and the chelating agent on the plating.

According to a further aspect of the present invention, there is provided a method for forming a hexavalent chromium free, black conversion film, which comprises the step of bringing zinc or zinc alloy plating into contact with the foregoing processing solution.

The substrates used in the present invention may be a variety of metals such as iron, nickel and copper, alloys thereof and metals or alloys such as aluminum, which have been subjected to zincate treatment and the substrate may have a variety of shapes such as plate-like, rectangular prism-like, column-like, cylindrical and spherical shapes.

The foregoing substrate is plated with zinc or a zinc alloy according to the usual method. The zinc-plating layer may be deposited on the substrate using either, for instance, acidic baths such as a sulfuric acid bath, an ammonium chloride bath or a potassium chloride bath, and alkaline baths such as an alkaline non-cyanide bath and an alkaline cyanide bath, but an alkaline non-cyanide bath (NZ-98 available from Dipsol Chemicals Co., Ltd.) is preferable.

In addition, examples of zinc alloy plating are zinc-iron alloy plating, zinc-nickel alloy plating having a rate of nickel-co-deposition ranging from 5 to 20% by mass, zinc-cobalt alloy plating and tin-zinc alloy plating. The thickness of the zinc or zinc alloy plating to be deposited on the substrate may arbitrarily be selected, but it is desirably not less than 1 μm and preferably 5 to 25 μm.

In the present invention, after the zinc or zinc alloy plating is deposited on a substrate according to the foregoing method, if desired, the plated substrate is water-rinsed or subjected to nitrate activation processing after being water-rinsed, and then brought into contact with a processing solution for forming a hexavalent chromium free, black conversion film according to the present invention. For instance, the zinc or zinc alloy plating subjected to a dipping treatment using this processing solution.

In the foregoing processing solution of the present invention, the source of the trivalent chromium may be any chromium compound containing trivalent chromium, but preferred examples thereof usable herein are trivalent chromium salts such as chromium chloride, chromium sulfate, chromium nitrate, chromium phosphate and chromium acetate or it is also possible to reduce hexavalent chromium such as chromic acid or dichromic acid into trivalent chromium using a reducing agent. Particularly preferable trivalent chromium source is chromium phosphate ($Cr(H_nPO_4)_{(3/(3-n))}$). The foregoing sources of trivalent chromium may be used alone or in any combination of at least two of them. The trivalent chromium concentration in the processing solution is not limited. It is preferably as low as possible from the viewpoint of the easiness of the wastewater treatment, but it is preferably 0.5 to 10 g/L and most preferably 0.8 to 5 g/L, while taking into account the corrosion resistance. In the present invention, the use of trivalent chromium in such a low concentration falling within the range specified above is also quite advantageous from the viewpoint of the wastewater treatment and the processing cost.

The processing solution of the present invention comprises nitrate ions in a mole ratio of nitrate ions to a trivalent chromium ($NO^{3-}/Cr^{3+}$) of less than 0.5/1, and preferably in a range of from 0.02/1 to 0.25/1. The nitrate ion concentration in the processing solution preferably ranges from 0.1 to 1 g/L. Examples of the nitrate ion source include nitric acid or a salt thereof.

Examples of the chelating agent used in the processing solution of the present invention include a hydroxycarboxylic acid such as tartaric acid and malic acid, a monocarboxylic acid, a polyvalent carboxylic acid such as a dicarboxylic acid such as oxalic acid, malonic acid, succinic acid, citric acid and adipic acid, or a tricarboxylic acid, aminocarboxylic acid such as glysinic acid. Moreover, the chelating agent may be used alone or in any combination of at least two of these acids or salts thereof (e.g. salt of sodium, potassium, ammonium or the like). The chelating agent concentration in the processing solution preferably ranges from 1 to 40 g/L, and more preferably 5 to 35 g/L in total.

The molar ratio of the chelating agent to the trivalent chromium (the chelating agent/$Cr^{3+}$) present in the processing solution of the present invention preferably ranges from 0.2/1 to 4/1 and more preferably 1/1 to 4/1.

The processing solution of the present invention comprises cobalt ions and/or nickel ions. As the sources of the cobalt ions and/or nickel ions, there may be used any metallic compounds containing either of these metals. One of these metallic compounds or any combination of at least two of them may be used, but one or more of each of metal salt, cobalt and nickel, is preferably used. The metallic salt concentration in the processing solution preferably ranges from 0.1 to 2 g/L, and more preferably 0.5 to 1.5 g/L in total.

In addition, the processing solution of the present invention may comprise monovalent to hexavalent metal ions, for example silicon, iron, titan, zirconium, tungsten, vanadium, molybdenum, strontium, niobium, tantalum, manganese, calcium, barium, magnesium, aluminum and the like. Said metal ions may be added alone or in any combination of at least two of them to the processing solution of the present invention. Moreover, as the sources of said metal ions, there may be used any metallic compounds containing either of these metals, but nitrate, sulfate or chloride are preferably used. These metallic compounds may be used alone or in any combination of at least two of them. The concentration in the processing solution preferably ranges from 0.05 to 3.0 g/L, and more preferably 0.1 to 2.0 g/L in total.

The trivalent chromium and a chelating agent such as oxalic acid should be present in the processing solution in the form of a stable water-soluble complex formed therebetween, which is supposed to have a structure represented by the following general formula, while the metal ions such as cobalt ions should stably exist in the solution without causing any precipitation by forming a hardly soluble metal salt with the chelating agent.

$$[(Cr)_1.(A)_m]^{+3l-mn},$$

wherein A represents a chelating agent, and n represents a valence of the chelating agent.

For instance, if the foregoing stable complex is not formed in the solution or excess chelating agents such as oxalic acid ions are present in the processing solution, metal ions such as cobalt ions react with chelating agents present in the processing solution in its free state to thus form precipitates of a hardly soluble metal salt. As a result, the processing solution cannot form any chemical conversion film (coating) having excellent corrosion resistance.

In order to obtain an excellent black film, the molar ratio of the chelating agent to the trivalent chromium (m/l) in the processing solution of the present invention preferably ranges from 0.2/1 to 4/1.

In addition, an even more excellent black film can be obtained by adding phosphate ions to the foregoing processing solution. The sources of phosphate ions include oxyacid of phosphorus such as phosphoric acid or phosphorous acid and a salt thereof. One of these sources or any combination of at least two of them may be used. The concentration of phosphate ions in the processing solution preferably ranges from 0.1 to 50 g/L, and more preferably 5 to 25 g/L.

In addition, sulfate ions, halogen ions and/or borate ions may be added to the foregoing processing solution. Examples of the sources of these ions include sulfuric acid, hydrochloric acid, boric acid and an inorganic salt thereof and the like. The concentration of ions of these inorganic acids in the processing solution preferably ranges from 1 to 50 g/L, and more preferably 1 to 20 g/L in total.

The pH value of the processing solution of the present invention is preferably adjusted to the range of 0.5 to 4 and more preferably 2 to 3. In this respect, it is possible to use ions of the foregoing inorganic acids or an alkaline agent such as an alkali hydroxide or aqueous ammonia in order to adjust the pH value thereof to the range specified above.

The rest (balance) of the processing solution used in the present invention, except for the foregoing components, is water.

If zinc or zinc alloy plating is brought into contact with the processing solution according to the present invention, the components of the solution react with zinc to thus form a hexavalent chromium free, black conversion film on the zinc or zinc alloy plating, as is presumed below.

As the method for bringing the zinc or zinc alloy plating into contact with the foregoing processing solution according to the present invention, it is usual to immerse an article plated with zinc or zinc alloy in the foregoing processing solution. For instance, such an article is immersed in the solution maintained at a temperature ranging from 10 to 80° C. and more preferably 40 to 60° C. for preferably 5 to 600 seconds and more preferably 30 to 120 seconds.

In this connection, the subject to be treated may be immersed in a dilute nitric acid solution in order to activate the surface of the zinc or zinc alloy plating layers, before it is subjected to the trivalent chromate treatment.

The conditions and processing operations other than those described above may be determined or selected in accordance with the conventional hexavalent chromate processing.

In addition, further improvement of the corrosion resistance of the film can be achieved by subjecting the trivalent chromate treated film to aging treatment (heat treatment). In cases where it is applied to zinc-nickel alloy plating layers, particularly good effects are obtained. The aging treatment is conducted at 100 to 250° C. for 10 to 300 minutes, preferably at 150 to 200° C. for 10 to 300 minutes, and more preferably at 200° C. for 4 hours.

Moreover, a topcoat film may be applied onto the hexavalent chromium free, black conversion film and this would permit the further improvement of the corrosion resistance of the film. In other words, this is a quite effective means for imparting more excellent corrosion resistance to the film. For instance, the zinc or zinc alloy plating is first subjected to the foregoing trivalent chromate treatment, followed by washing the plating with water, subjecting the plating to immersion or electrolyzation in a topcoating solution and then drying the processed article. Alternatively, the article is subjected to immersion or electrolyzation in a topcoating solution after the trivalent chromate treatment and the subsequent drying treatment, and then dried. The term "topcoat" effectively used herein means not only an inorganic film of, for instance, a silicate or a phosphoric acid salt, but also an organic film of, for instance, polyethylene, polyvinyl chloride, polystyrene, polypropylene, methacrylic resin, polycarbonate, polyamide, polyacetal, fluorine plastic, urea resin, phenolic resin, unsaturated polyester resin, polyurethane, alkyd resin, epoxy resin or melamine resin.

The topcoating liquids for forming such an topcoat film usable herein may be, for instance, DIPCOAT W or CC445 available from Dipsol Chemicals Co., Ltd. The thickness of the topcoat film may arbitrarily be selected, but it desirably ranges from 0.1 to 30 μm.

Reaction Mechanism of Film-Formation

The reaction mechanism of the hexavalent chromium free, black conversion film-formation according to the present invention can be supposed to be as follows:

(i) A dissolution reaction of Zn, Fe, Ni or the like from a plating film by the action of hydrogen ions and an oxidizing agent such as nitric acid, a supply of metal ions such as zinc to the plating film and re-dissolution reaction of deposits;

(ii) Consumption of hydrogen ions and an increase of the pH value at the interface to be plated subsequent to the dissolution reaction:

$$Zn \rightarrow Zn^{2+} + 2e^-,\ 2H^+ + 2e^- \rightarrow 2H,\ 2H + \tfrac{1}{2} O_2 \rightarrow H_2O \text{ (an increase in the pH value);}$$

(iii) The reduction of the stability of a chelating agent, the formation and deposition of Cr hydroxide, and the generation and supply of excess oxalic acid, due to the increase in the pH value:

(iv) Formation and deposition of a hardly soluble metal salt through the reaction of the excess chelating agent with metal ions in the solution. For example, in a case where a chelating agent is an oxalic acid and a metal is cobalt:

$$[CrC_2O_4.(H_2O)_4]^+ \rightarrow Cr(OH)_3\downarrow + C_2O_4^{2-} + 3H^+ + H_2O;$$

$$C_2O_4^{2-} + Co^{2-} \rightarrow CoC_2O_4\downarrow;$$

(v) Formation and deposition of a hardly soluble metal salt through the reaction of the anions such as phosphoric acid in the solution with metal ions such as zinc, Fe and Ni dissolved from the plating film into the solution or Ni, Co and/or Fe added into the solution, and the deposition of another hardly soluble substance produced when the plating film is dissolved onto the zinc or zinc alloy plating film.

For example, in a case where phosphate ions are added into the solution:

$$X_mY_n(H_2PO_4)_2 \rightarrow X_mY_n.(PO_4)_2.4H_2O\downarrow;$$

M+n=3, X, Y: metal ions such as zinc, iron, nickel and/or manganese.

(vi) These reactions are repeated to thus cause the growth of the chemical conversion film.

In this connection, it would appear that the black conversion film is a composite film of (iii), (iv) and (v).

In the concentration of nitrate ions being within a suitable range (0.1 g/L to 1 g/L), it would appear that the re-dissolution reaction of the hardly soluble metal salt in (v) is inhibited and the hardly soluble metal salt in (v) is incorporated into the chemical conversion film, so that the film exhibits a black feature.

DESCRIPTION OF THE PREFERRED EMBODIMENTS

Examples 1 to 6

A steel plate, which had been plated with zincates using a NZ-98 solution available from Dipsol Chemicals Co., Ltd. to form a Zn plating layer having a thickness of 8 μm, was immersed in a trivalent chromate-containing processing solution having a composition as shown in the following Table 1.

TABLE 1

| | Ex. No. | | | | | |
|---|---|---|---|---|---|---|
| | 1 | 2 | 3 | 4 | 5 | 6 |
| $Cr^{3+}$ (g/L) | 4.5 | 4.5 | 4.5 | 4.5 | 4.5 | 2 |
| $NO_3^-$ (g/L) | 0.2 | 0.4 | 0.1 | 0.4 | 0.6 | 0.4 |
| Mole ratio of $NO_3^-/Cr^{3+}$ | 0.04/1 | 0.07/1 | 0.02/1 | 0.07/1 | 0.11/1 | 0.17/1 |
| $PO_4^{3-}$ (g/L) | 12 | 12 | 0 | 15 | 12 | 12 |
| $SO_4^{2-}$ (g/L) | 15 | 0 | 0 | 2 | 0 | 2 |
| $Cl^-$ (g/L) | 10 | 10 | 10 | 0 | 15 | 0 |
| Oxalic acid (g/L) | 15 | 15 | 7 | 0 | 0 | 0 |
| Malonic acid (g/L) | 0 | 0 | 7 | 15 | 12 | 12 |
| Succinic acid (g/L) | 0 | 10 | 20 | 0 | 0 | 0 |
| Adipic acid (g/L) | 0 | 0 | 0 | 20 | 0 | 0 |
| Molar ratio of the chelating agent/$Cr^{3+}$ | 2.0/1 | 3.0/1 | 3.7/1 | 3.4/1 | 1.4/1 | 1.4/1 |
| Co (g/L) | 1 | 1.5 | 0.5 | 1 | 1 | 1 |
| Ni (g/L) | 0.1 | 0 | 1.0 | 0 | 0.3 | 0.5 |
| Other metal salt | Si | Si | Ti | Si | Si | Si |
| pH of Processing Soln. | 2.3 | 2.3 | 2.3 | 2.4 | 2.6 | 2.5 |
| Processing Temp. (° C.) | 50 | 50 | 60 | 50 | 40 | 30 |
| Processing time (sec.) | 30 | 60 | 120 | 60 | 60 | 60 |

In Table 1, $Cr^{3+}$ sources used were $CrCl_3$ (in Examples 1, 2, 3 and 5), $CrPO_4$ (in Examples 4 and 6) and $Cr(NO_3)_3$ (in Example 5). The concentrations of $NO_3^-$ were adjusted by $Cr(NO_3)_3$ (in Example 5) or by adding $HNO_3$ (in Examples 1, 2 and 3) or $NaNO_3$ (in Examples 4 and 6). Further, the $SO_4^{2-}$ source used was $Na_2SO_4$ and the $PO_4^{3-}$ source used was $NaH_2PO_4$. The balance of each processing solution was water. The metallic salts used such as Co and Ni were its sulfate (in Examples 1, 4 and 6) and chloride (in Examples 2, 3 and 5). The Si source used was colloidal silica and the Ti source used was titanium trichloride. The concentration of metal ions other than Co and Ni was 1 g/L. The pH value of each solution was adjusted using NaOH.

Examples 7 to 10

A steel plate, which had been plated with alkaline zinc-nickel alloy (Ni %: 5 to 15%) or zinc-iron alloy (Fe %: 0.3 to 2.0%) in a thickness of 8 μm, was immersed in a trivalent chromate-containing processing solution having a composition as shown in the following Table 2.

TABLE 2

| | Ex. No. | | | |
|---|---|---|---|---|
| | 7 | 8 | 9 | 10 |
| $Cr^{3+}$ (g/L) | 4.5 | 4.5 | 4.5 | 4.5 |
| $NO_3^-$ (g/L) | 0.6 | 0.4 | 0.2 | 0.4 |
| Mole ratio of $NO_3^-/Cr^{3+}$ | 0.11/1 | 0.07/1 | 0.04/1 | 0.07/1 |
| $PO_4^{3-}$ (g/L) | 12 | 12 | 12 | 15 |
| $SO_4^{2-}$ (g/L) | 10 | 0 | 15 | 2 |
| $Cl^-$ (g/L) | 0 | 10 | 0 | 0 |
| Oxalic acid (g/L) | 15 | 7 | 15 | 15 |
| Malonic acid (g/L) | 0 | 7 | 0 | 0 |
| Succinic acid (g/L) | 10 | 0 | 0 | 0 |
| Adipic acid (g/L) | 0 | 0 | 0 | 20 |
| Molar ratio of the chelating agent/$Cr^{3+}$ | 3.0/1 | 1.7/1 | 2.0/1 | 3.7/1 |
| Co (g/L) | 1 | 1 | 1 | 1 |
| Ni (g/L) | 0.3 | 0 | 0.1 | 0 |
| Other metal salt | Si | Si | Si | Si |
| pH of Processing Soln. | 2.6 | 2.0 | 2.3 | 2.5 |
| Processing Temp. (° C.) | 35 | 50 | 50 | 40 |
| Processing time (sec.) | 60 | 60 | 60 | 60 |
| Plating Eutectoid rate (%) | Zn—Ni 6.5 | Zn—Ni 15 | Zn—Fe 0.5 | Zn—Fe 2.0 |

In Table 2, the $Cr^{3+}$ sources used were $CrCl_3$ (in Example 8) and $CrPO_4$ (in Examples 7, 9 and 10).

The concentrations of $NO_3^-$ were adjusted by adding $HNO_3$ (in Example 8) or $NaNO_3$ (in Examples 7, 9 and 10). Further, the $SO_4^{2-}$ source used was $Na_2SO_4$ and the $PO_4^{3-}$ source used was $NaH_2PO_4$. The balance of each processing solution was water. The metal salts used such as Co and Ni were its sulfate (in Examples 7 and 9) and chloride (in Example 8). The Si source used was colloidal silica and the concentration thereof was 1 g/L. The pH value of each solution was adjusted using NaOH.

Examples 11 to 14

After the trivalent chromate treatment in Examples 1, 8 and 9, the steel plate was subjected to a topcoating treatment. The conditions for the topcoating treatment used herein are summarized in the following Table 3.

TABLE 3

| | Ex. No. | | | |
|---|---|---|---|---|
| | 11 | 12 | 13 | 14 |
| Trivalent chromate treatment | Example 1 | Example 8 | Example 9 | Example 9 |
| Kind of Topcoat | Silicate type inorganic film | Silicate type inorganic film | Polyurethane type organic film | Methacrylic resin type organic film |

TABLE 3-continued

| | Ex. No. | | | |
|---|---|---|---|---|
| | 11 | 12 | 13 | 14 |
| Concn. Of Processing Soln. | 200 mL/L | 200 mL/L | 100 mL/L | Stock solution was used as such |
| Processing Conditions | 45° C. - 45 sec | 45° C. - 45 sec | 25° C. - 60 sec | 25° C. - 60 sec |
| Name and Origin of Reagent | CC-445 available from Dipsol Chemicals Co., Ltd. | CC-445 available from Dipsol Chemicals Co., Ltd. | SUPERFLEX R3000 available from Dai-ichi Kogyo Seiyaku Co., Ltd. | DIPCOAT W available from Dipsol Chemicals Co., Ltd. |

Comparative Example 1

A steel plate, which had been plated with zinc in a thickness of 8 μm, as a comparative example, was subjected to a hexavalent chromate treatment. The hexavalent chromate bath used herein was ZB-535A (200 mL/L) and ZB-535B (10 mL/L) available from Dipsol Chemicals Co., Ltd.

Comparative Example 2

A steel plate, which had been plated with zinc in a thickness of 8 μm, as a comparative example, was subjected to a trivalent chromate treatment using a processing solution having the following composition: 15 g/L (3.3 g/L as expressed in terms of $Cr^{3+}$) of $Cr(NO_3)_3$; 10 g/L of $NaNO_3$; and 10 g/L of oxalic acid (pH: 2.0). In this respect, the processing was carried out at 30° C. for 40 seconds.

Comparative Example 3

A steel plate, which had been plated with zinc in a thickness of 8 μm, as a comparative example, was subjected to a trivalent chromate treatment using a processing solution having the following composition as disclosed in the example of J.P. KOKAI No. 2000-509434: 50 g/L (9.8 g/L as expressed in terms of $Cr^{3+}$) of $CrCl_3.6H_2O$; 3 g/L (0.6 g/L as expressed in terms of Co) of $Co(NO_3)_2^-$; 100 g/L of $NaNO_3$; and 31.2 g/L of malonic acid (pH: 2.0). In this respect, the processing was carried out at 30° C. for 40 seconds.

Processing Steps:

In these Examples and Comparative Examples, the details of the processing steps are as follows:

Plating→Water Rinsing→Activation with Dilute Nitric Acid→Water Rinsing→Trivalent Chromate Treatment→Water Rinsing→(Topcoating Treatment)[1]→Drying[2]→(Heat Treatment)[3]

Note 1: This step was used only when the steel plate was subjected to a topcoating treatment.

Note 2: The drying step was carried out at a temperature ranging from 60 to 80° C. for 10 minutes.

Note 3: When carrying out the test for the corrosion resistance after heating, each steel plate was treated at 200° C. for 2 hours.

Salt Spray Test:

The zinc plated steel plates obtained in Examples 1 to 14 and Comparative Examples 1 to 3 and each provided thereon with a trivalent chromate film were inspected for the appearance and subjected to the salt spray test (JIS-Z-2371). The results thus obtained are summarized in the following Table 4.

As will be clear from the data listed in Table 4, it is found that the films obtained in Examples 1 to 10 show the corrosion resistance almost identical or superior to those observed for the chromate film obtained in Comparative Examples 1 to 3. In addition, the films of Examples 11 to 14, which were subjected to a topcoating treatment, especially at the time required for the formation of red rust, show corrosion resistance superior to that observed for the conventional chromate film.

TABLE 4

Results of Salt Spray Test (JIS-Z-2371)

| Ex. No. | Appearance of Film | Corrosion Resistance (1) (hr.) | Corrosion Resistance After Heating (2) (hr.) |
|---|---|---|---|
| 1 | Black | 120/600 | 240 |
| 2 | Black | 72/500 | 240 |
| 3 | Black | 72/400 | 120 |
| 4 | Black | 96/500 | 240 |
| 5 | Black | 120/500 | 240 |
| 6 | Black | 120/500 | 240 |
| 7 | Black | 120/800 | 240 |
| 8 | Black | 120/1500 | 240 |
| 9 | Black | 240/1000 | 240 |
| 10 | Black | 240/1000 | 240 |
| 11 | Black | 240/1000 | |
| 12 | Black | 300/2000 | |
| 13 | Black | 300/1200 | |
| 14 | Black | 300/1200 | |
| 1* | Black | 120/500 | 12 |
| 2* | Pale Blue | 24/250 | 24 |
| 3* | Interference Color | 72/300 | 48 |

(1) Time (hour) required for the formation of white rust/red rust (5% by mass).
(2) Time (hour) required for the formation of white rust (5% by mass).
*Comparative Example

Effect of the Invention

As has been described above in detail, the present invention permits the formation of a hexavalent chromium free, black conversion film directly on zinc or zinc alloy plating layers. The plated article obtained according to this method has not only the corrosion resistance due to the zinc or zinc alloy plating as such, but also the excellent corrosion resistance due to the presence of the trivalent chromate film. Moreover, the processing solution used in the present invention comprises trivalent chromium in a low concentration and therefore, the present invention is quite advantageous from the viewpoint of the wastewater treatment and production and processing cost. The film obtained by directly forming trivalent chromate on the plating possesses not only corrosion resistance, resistance to salt water and after heating resistance identical or superior to those observed for the conventional hexavalent chromium-containing film, but also expresses a black feature, and therefore, the film of the present invention can widely be used in a variety of fields in the future.

What is claimed is:

1. A processing solution for forming a hexavalent chromium free, black conversion film on a zinc or zinc alloy plating layer(s), the processing solution consisting of:

nitrate ions and trivalent chromium in a mole ratio ($NO_3^-/Cr^{3+}$) of less than 0.5/1, and cobalt and/or nickel ions in an amount of 0.1 to 2 g/L, optionally one or more metal ions selected from the group consisting of silicon, iron, titanium, zirconium, tungsten, vanadium, molybdenum, strontium, niobium, tantalum, manganese, calcium, barium, magnesium and aluminum;

optionally phosphate ions and one or more ions selected from the group consisting of a sulfate ion, a halogen ion, and a boron ion; and the balance water, wherein the trivalent chromium is present in the form of a water-soluble complex with a chelating agent, wherein the trivalent chromium concentration ranges from 0.5 to 10 g/L; a molar ratio of the chelating agent to the trivalent chromium ranges from 0.2/1 to 4/1; and a pH of from 0.5 to 4.

2. The processing solution according to claim 1, wherein the chelating agent is one or more members selected from the group consisting of monocarboxylic acids, dicarboxylic acids, tricarboxylic acids, hydroxycarboxylic acids, aminocarboxylic acids and salts thereof.

3. The processing solution according to claim 2, wherein the chelating agent is one or more members selected from the group consisting of oxalic acid, malonic acid, succinic acid and a salt thereof.

4. The processing solution according to claim 1, wherein phosphate ions are present.

5. The processing solution according to claim 1, wherein one or more ions selected form the group consisting of a sulfate ion, a halogen ion and a borate ion are present.

6. The processing solution according to claim 1, wherein the cobalt ions and/or nickel ions are stably present in the processing solution without causing any precipitation by forming a hardly soluble metal salt with the chelating agent.

7. The processing solution according to claim 6, wherein the processing solution reacts with zinc when it is brought into contact with the zinc or zinc alloy plating to form a hexavalent chromium free, black conversion film comprising zinc, chromium, cobalt and/or nickel, and the chelating agent on the plating layer(s).

8. The processing solution according to claim 1, wherein the trivalent chromium source is chromium phosphate.

9. The processing solution according to claim 1, wherein one or more metal ions selected from the group consisting of silicon, iron, titanium, zirconium, tungsten, vanadium, molybdenum, strontium, niobium, tantalum, manganese, calcium, barium, magnesium and aluminum are present.

* * * * *

UNITED STATES PATENT AND TRADEMARK OFFICE

CERTIFICATE OF CORRECTION

PATENT NO. : 9,057,133 B2
APPLICATION NO. : 12/401202
DATED : June 16, 2015
INVENTOR(S) : Manabu Inoue et al.

It is certified that error appears in the above-identified patent and that said Letters Patent is hereby corrected as shown below:

On the title page, Item (75), the 3rd Inventor's Information is incorrect. Item (75) should read:

--(75) Inventors: Manabu Inoue, Tokyo (JP);
Ryo Nakajima, Tokyo (JP);
Kazuhiro Watanabe (Deceased), Tokyo (JP);
Toyoji Watanabe, Legal Representative, Fuji (JP);
Fumie Watanabe, Legal Representative, Fuji (JP);
Yutaka Watanabe, Legal Representative, Fuji (JP);
Takeshi Watanabe, Legal Representative, Fuji (JP);
Kimitaka Watanabe, Tokyo (JP)--

On the title page, Item (45), the Terminal Disclaimer Information is incorrect. Item (45) and the Notice Information should read:

--(45) Date of Patent: * Jun. 16, 2015

On the Title Page:

The first or sole Notice should read --

Subject to any disclaimer, the term of this patent is extended or adjusted under 35 U.S.C. 154(b) by 307 days.

This patent is subject to a terminal disclaimer.--

Signed and Sealed this
Twenty-seventh Day of October, 2015

Michelle K. Lee

Michelle K. Lee
*Director of the United States Patent and Trademark Office*